US005634407A

United States Patent [19]

Niederer

[11] Patent Number: 5,634,407

[45] Date of Patent: Jun. 3, 1997

[54] TRANSPORT CABLEWAY

[76] Inventor: Hermann Niederer, Rosenbühelrotte 12, A-3213 Frankenfels, Austria

[21] Appl. No.: 553,323

[22] PCT Filed: May 18, 1994

[86] PCT No.: PCT/AT94/00070

§ 371 Date: Mar. 1, 1996

§ 102(e) Date: Mar. 1, 1996

[87] PCT Pub. No.: WO94/26570

PCT Pub. Date: Nov. 24, 1994

[30] Foreign Application Priority Data

May 19, 1993 [AU] Australia ..... A 990/93

[51] Int. Cl.[6] ..... B61B 7/06

[52] U.S. Cl. ..... 105/150; 105/148; 104/112; 212/328

[58] Field of Search ..... 104/89, 93, 112, 104/178, 173.1, 183; 105/150, 151, 148; 212/328

[56] References Cited

U.S. PATENT DOCUMENTS

| | | | |
|---|---|---|---|
| 535,703 | 3/1895 | Lamb | 105/150 |
| 1,266,636 | 5/1918 | Snively | 212/328 |
| 1,551,223 | 8/1925 | Smith | 105/150 |
| 1,846,537 | 2/1932 | Withrow | 105/151 |
| 2,019,760 | 11/1935 | Mattro | 105/148 |
| 2,730,047 | 1/1956 | Rollongs | 104/112 |
| 3,018,738 | 1/1962 | Naud | 105/151 |
| 3,022,747 | 2/1962 | McIntyre | 104/178 |
| 3,750,591 | 8/1973 | Makinster et al. | 104/112 |

FOREIGN PATENT DOCUMENTS

| | | |
|---|---|---|
| 89616 | 12/1895 | Germany . |
| 1 232 715 | 1/1967 | Germany . |
| 41 30 636 A1 | 4/1992 | Germany . |

*Primary Examiner*—S. Joseph Morano
*Attorney, Agent, or Firm*—Nixon & Vanderhye P.C.

[57] ABSTRACT

The transport cableway for transporting heavy loads includes a motor-driven cable winch fixed on a pivotable stirrup. The pivotable stirrup is pivotable relative to a part rigidly connected with a housing containing the drive motor and the hydraulic drive, and partially encompassing the carrying cable with a hook-shaped end.

11 Claims, 3 Drawing Sheets

TRANSPORT CABLEWAY

TECHNICAL FIELD

The invention relates to a transport cableway for transporting heavy loads of the type including a motor-driven cable winch and a drive for displacing a housing containing at least one motor as well as running rollers for a carrying cable.

BACKGROUND AND SUMMARY OF THE INVENTION

Transporting cableways of the initially defined kind are used, in particular, in impassable terrain, for instance, to carry trees down into the valley in forestry, or to get down any other heavy loads. When transporting trees, and after having installed the appropriate supports for the carrying cable of a cableway, the trees or loads to be transported away are not aligned with of the carrying cable, and must be seized and pulled up laterally of such carrying cables of the cableway. It is known to equip cableways of the initially defined kind with housings carrying cable winches and containing the drive motor. Usually, a Diesel generator coupled with a hydraulic pump is used for driving such transportation cableways. If loads are seized by means of such a cableway housing laterally of the fall line or laterally of the projection of the carrying cable, the transport housing is caused to make a more or less large excursion from its vertical position, thus entailing the overall risk of the lubrication of the drive motors being impeded due to an inadmissibly slanted position, which even may cause the drive to be automatically switched off. In such configurations in which the cable winch is directly connected with the housing, it must be remembered, that the housing walls, and/or the housing itself, are made of stable heavy materials, which implies a relatively large weight for the cableway housing itself. Finally, such an excursion of the heavy drive motor from its vertical position due to reaction forces eccentrically applied during the use of the cable winch results in an undesired pendulum oscillation of the heavy motor and of the housing as the reaction forces rapidly decrease, for instance, upon lifting of the load from the bottom, thus excessively stressing the pylons or supports of the carrying cable, as well as the carrying cable itself.

In U.S. Pat. No. 3,022,747 a transport and lifting arrangement is proposed, which, as opposed to known rigid systems, allows for the perpendicular alignment of the drive motor. That position of the motor is obtained by the articulated connection of the rollers with the housing carrying the motor, the housing at the same time taking over any loads. The two rollers, however are not coupled in a rigid manner.

The invention here aims at further developing a transportation cableway of the initially defined kind with a view to being able to use more light-weight structural components for the motor housing and to unacceptable excursions of the motor housing during operation. Furthermore, the invention aims at considerably increasing the operational safety, in particular, if reaction forces of the load suddenly get slight, and at avoiding overloading of the carrying cable or of the supports. To solve this problem, the configuration according to the invention substantially is such that the running rollers are journalled in or on a carrier rigidly connected with the housing carrying the drive motor, that a hook-shaped stirrup partially encompassing the carrying cable is mounted on a part rigidly connected with the housing so as to be pivotable about the carrying cable, and that the cable winch is fixed to the pivotable stirrup.

By arranging a hook-shaped stirrup partially encompassing the carrying cable in addition to the carrier for rollers that cooperate with the carrying cable, and by fixing the cable winch thereto, it is ensured that, when eccentrically pulling in heavy loads using the cable winch, an excursion of only this additional stirrup is caused, and the drive motor as well as the hydraulic drive are able to remain in a substantially perpendicular position. The risk of the lubrication being interrupted in such cases is eliminated in this manner, and by the fact that the load is applied to the hook-shaped stirrup partially encompassing the carrying cable, and by the fact that the housing may be of a substantially more light-weight construction. This is possible because the housing must safely absorb only the carrying forces for the driving aggregates.

By the construction according to the invention it is, moreover, possible to choose substantially simpler configurations in respect of the drive mechanism. Since the carrying cable is partially encompassed, adequate safety is ensured, and excessive pivotal and swinging movements during the application of load is avoided, thus increasing operational safety. Another advantage is that supports can be moved over without difficulty, and without making compromises in terms of the stability of the construction of the carrying cable supports. In the configuration according to the invention, the traction or safety cable simply may be arranged to lie on the earth, the configuration advantageously being devised such that the drive mechanism is rigidly connected with the housing and cooperates with a safety cable which is guided parallel to the carrying cable in the region of the pivotal mounting of the stirrup and passes through the mounting of the stirrup along with the carrying cable, thus ensuring the simple guidance of the traction cable or safety cable in the region in which the drive mechanism is to have effect.

In a particularly advantageous manner, mounting is devised such that the mounting of the pivotable stirrup is designed as a roller or roller bearing on the periphery of a bearing part connected with the carrier of the rollers, encompassing the same by more than 180° and less than 360°. In such a configuration, a high stability of the bearings and a structurally simple solution are provided, allowing for the safe absorption even of high eccentric forces without overstressing the respective structural components.

The precise supply of the traction or safety cable is achieved in that the bearing part comprises a V-shaped recess on its side facing the housing and a roller guide for the traction or safety cable outside of the pivot axis of the hook-shaped stirrup.

Advantageously, the stirrup is designed to be substantially C-shaped, the free ends of the legs being hook-shaped and comprising the pivotal mounting, and the pivotable stirrup encompassing the housing. In this manner, a high degree of stability and a favorable force introduction into the carrying cable are caused, taking effect over a great length of the carrying cable.

In order to be able to use short flexible power feed lines also with a stirrup of this kind and to avoid overloads created by reaction forces exerted on the lifting cable of the cable winch, the configuration advantageously is devised such that the cable winch is fixed on a leg of the pivotable stirrup in the vicinity of the pivot axis. More specifically a hydraulic drive is connected with a pump arranged within the housing and with the tank via hydraulic ducts, wherein the transport or lifting cable in a simple manner is directed from the cable winch to a roller in the central region of the stirrup via deflection pulleys. The reaction forces thus are applied approximately in the center of the C-shaped stirrup, the forces being evenly introduced into the carrier of the rollers; and into the two hooks arranged on both sides of the housing.

In a particularly simple manner, yet while renouncing the deflection pulleys and under a favorable force absorption, the configuration may be devised such that the cable winch is fixed approximately in the middle of the central region of the stirrup.

In a manner known per se, the housing may comprise at least one remote control receiver for actuating the drives such that manipulations in place are substantially facilitated.

On the whole, just one support for the rollers as well as the hook-shaped stirrup must be made of heavy and high-quality materials, and therefore the configuration advantageously is devised such that the housing is of light-weight construction, formed of aluminum and other light-weight materials, and that the stirrup as well as the roller support for the carrying rollers is comprised of high-tensile steel carriers.

In a particularly simple manner the configuration may be devised such that the drive mechanism is designed as a looping drive and that a carrying cable brake is connected with the housing.

Alternatively, the configuration may be such that the drive mechanism is designed as a crawler drive whose crawlers cooperate with the carrying cable thus providing for a particularly simple configuration in terms of construction.

In the following, the invention will be explained in more detail by way of an exemplary embodiment schematically illustrated in the drawing.

BRIEF DESCRIPTION OF THE DRAWINGS

Therein.

DETAILED DESCRIPTION OF THE DRAWINGS

Figure 1:
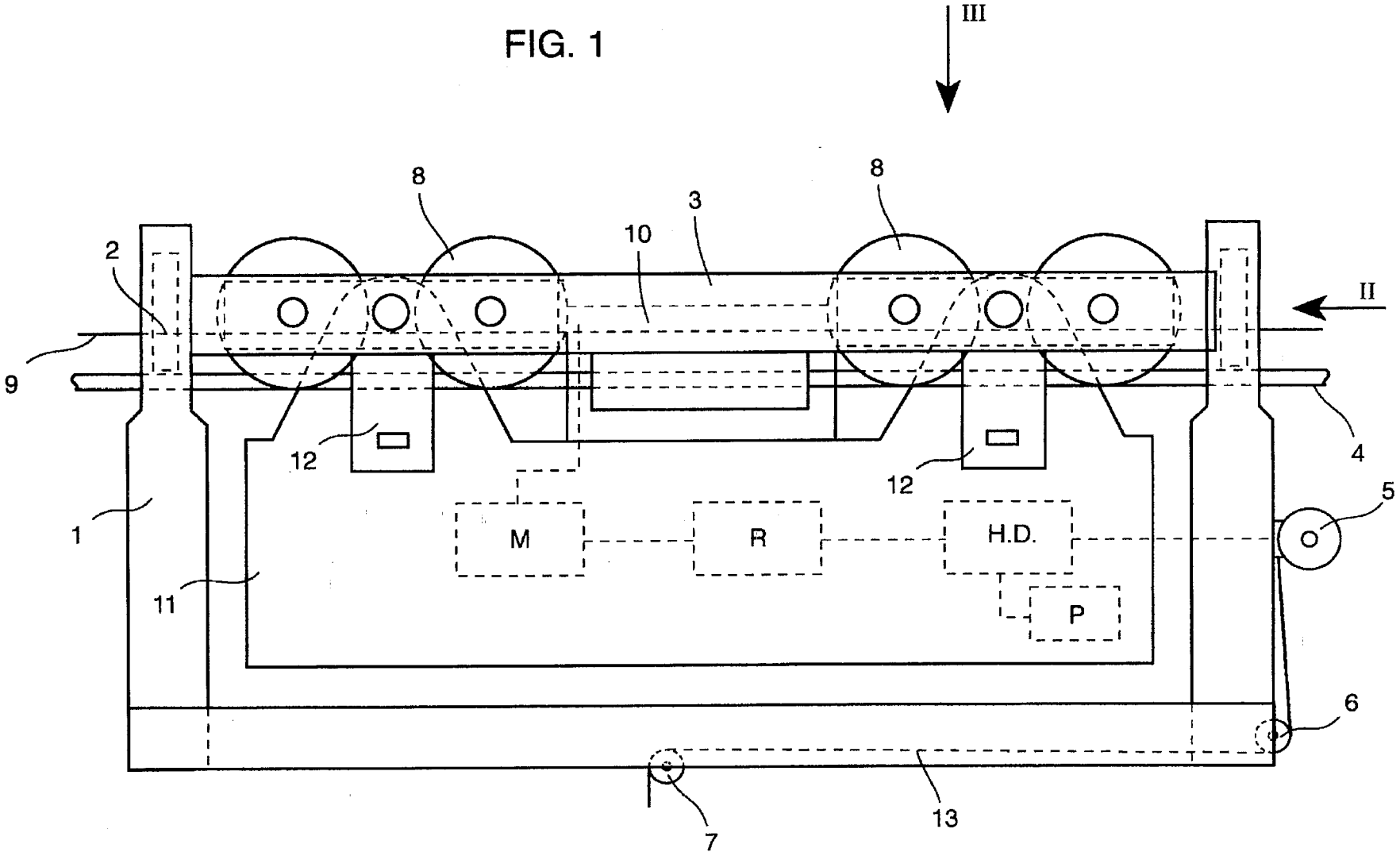
FIG. 1 is a diagrammatic side view of a carrying cableway according to the invention.

In FIG. 1, a substantially C-shaped stirrup is denoted by 1, which pivotably engages a carrier 3 via a bearing 2. The stirrup 1 encompasses a carrying cable 4 and carries a cable winch 5 on one of its substantially upright legs. Furthermore, deflection pulleys 6 and 7 are mounted within the C-shaped stirrup 1.

Four running rollers 8 are journalled in the carrier 3. In addition, a traction or safety rope 9 is provided, cooperating with a drive schematically indicated by 10. Safety rope or cable 9 extends substantially parallel to the carrying cable 4.

The housing 11 proper contains the motor M and the hydraulic components H.D. and is connected in an angularly rigid manner with the carrier 3 of the running rollers 8. The hydraulic drive H.D. is connected to a pump P, also located in housing 11. A remote control receiver R actuates the drives M and H.D. Furthermore, an additional safety means 12 is provided, which is to prevent the carrying cable 4 from coming out of the rollers 8 in case of excessive loads.

In FIG. 1, the transport or lifting cable 13 passes from the cable winch 5 and is conducted over the pulleys 6 and 7. The details of the pivotal mounting of the stirrup 1 on the carrier 3 and hence on a part that is rigidly connected with the housing 11 are illustrated in more detail in FIG. 2.

Figure 2:
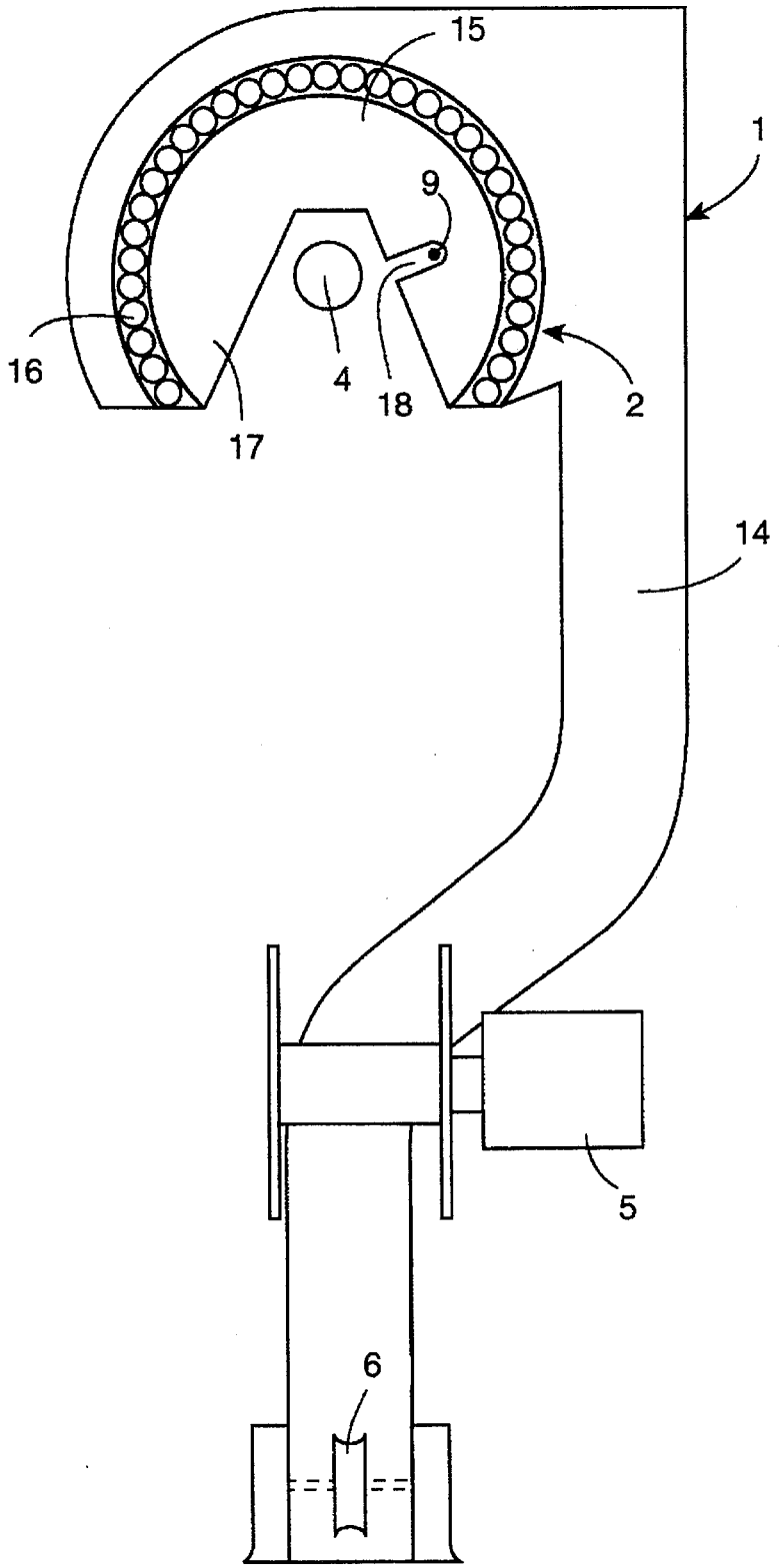
FIG. 2 is a view on the mounting of the stirrup in the direction of arrow II of FIG. 1.

From FIG. 2 the hook-shaped end 14 of the C-shaped stirrup 1 is apparent. The hook-shaped end 14 encompasses a bearing part 15, which in turn is rigidly connected with the carrier 3, the bearing 2 comprising a plurality of rolls 16.

The cable winch again is denoted by 5 and the first deflection pully for the lifting cable is denoted by 6.

The bearing part 15, which is connected with the carrier 3 on its end side, is formed with a substantially V-shaped cutout 17, in which the carrying cable 4 is inserted. Another recess 18 is provided for the traction or safety cable 9, the traction or safety cable being guided, via a roller not illustrated in detail, in the respective position eccentrically to the carrying cable 4 or pivot axis of the hook-Shaped end 15 of the C-shaped stirrup 1.

Figure 3:
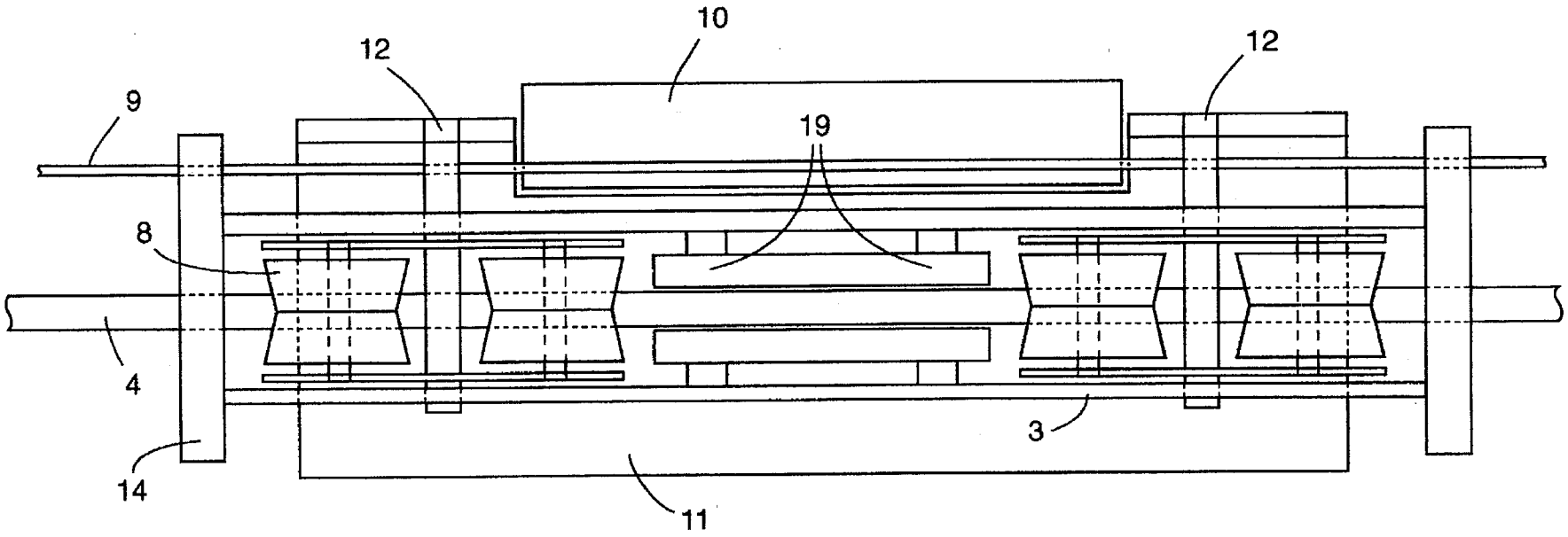
FIG. 3 is a view on the rollers, the drive and the rope brake in the direction of the arrow III of FIG. 1.

Referring to FIG. 3, the running rollers 8 are again apparent, resting on the carrying cable 4. The traction or safety cable 9, is offset from the carrying cable 4 and cooperates with a drive 10 designed as a looping drive. In the top view according to FIG. 3, a rope brake 19, furthermore, is to be seen. As for the rest, the reference numerals from FIGS. 1 and 2 have been retained.

I claim:

1. A transport cableway device for transporting heavy loads along a carrying cable, the device comprising:

a carrier;

a plurality of rollers adapted to engage and roll along said carrying cable, said rollers journalled in said carrier;

a housing substantially rigidly jointed to said carrier, enclosing a winch motor and a drive mechanism for moving said device along said carrying cable;

a substantially C-shaped stirrup pivotally mounted at opposite ends thereof to said carrier, said C-shaped stirrup partially enclosing said carrying cable; and a cable winch mounted on said C-shaped stirrup.

2. A transport cableway according to claim 1, wherein said drive mechanism is rigidly connected with the housing and cooperates with a safety cable which is guided substantially parallel to the carrying cable in a region of the pivotal mounting of the stirrup, to said carrier, and which passes through said stirrup along with the carrying cable.

3. A transport cable way according to claim 1 wherein said stirrup includes a plurality of roller bearings engaging a bearing part connected with said carrier and encompassing said bearing part by more than 180° and less than 360°.

4. A transport cableway according to claim 3 wherein said bearing part includes a first recess on a side facing the housing for receiving the carrying cable and a second recess for a safety cable.

5. A transport cableway according to claim 3 wherein said stirrup includes a pair of parallel legs, free ends of said legs being hook-shaped and encompassing said plurality of roller bearings.

6. A transport cableway according to claim 5 wherein said cable winch is fixed on one of said legs of the stirrup in the vicinity of the pivot axis, and includes a hydraulic motor drive connected with a pump arranged within the housing.

7. A transport cableway according to claim 6 wherein said housing encloses at least one remote control receiver for actuating said drives.

8. A transport cableway according to claim 1 wherein a lifting cable is directed from said cable winch to a roller in a central region of the stirrup via at least one deflection pulley.

9. A transport cableway according to claim 1 wherein said winch is fixed approximately in a central region of the stirrup.

10. A transport cableway according to claim 1 wherein said housing is formed of aluminum and said stirrup and carrier are comprised of high-tensile steel.

11. A transport cableway according to claim 1 wherein said drive mechanism is a looping drive, and wherein a carrying cable brake is connected with the housing.

* * * * *